United States Patent [19]

Drutchas

[11] 4,449,506

[45] May 22, 1984

[54] FUEL SUPPLY SYSTEM

[75] Inventor: Gilbert H. Drutchas, Birmingham, Mich.

[73] Assignee: TRW Inc., Cleveland, Ohio

[21] Appl. No.: 324,689

[22] Filed: Nov. 25, 1981

[51] Int. Cl.[3] ..... F02D 5/02; F02M 51/00

[52] U.S. Cl. ..... 123/458; 123/390; 123/512

[58] Field of Search ..... 123/350, 357, 375, 390, 123/446, 458, 480, 482, 497, 499, 506, 511, 512

[56] References Cited

U.S. PATENT DOCUMENTS

| | | | |
|---|---|---|---|
| 3,128,750 | 4/1964 | Schmidt | 123/390 X |
| 3,630,643 | 12/1971 | Eheim et al. . | |
| 3,741,182 | 6/1973 | Wade et al. | 123/459 |
| 3,788,597 | 1/1974 | Ichioka . | |
| 3,822,965 | 7/1974 | Drutchas . | |
| 3,930,759 | 1/1976 | Drutchas . | |
| 3,935,851 | 2/1976 | Wright et al. . | |
| 3,949,714 | 4/1976 | Mitchell . | |
| 3,971,348 | 7/1976 | Scofield . | |
| 4,176,641 | 12/1979 | Perr | 123/390 |

*Primary Examiner*—Parshotam S. Lall
*Assistant Examiner*—W. R. Wolfe
*Attorney, Agent, or Firm*—Yount & Tarolli

[57] ABSTRACT

In a fuel control system for a fuel injected internal combustion engine, fuel is pumped from a tank by a cheek plate unloading pump to the fuel rail which supplies the fuel injectors. The delivery pressure of the pump is controlled by a microprocessor which receives inputs from a number of sensors of engine operating variables. The microprocessor generates a control signal which controls the pump output pressure by actuating a solenoid-type linear actuator. The solenoid has an actuator rod which positions a spool in a control valve which regulates the pressure in a cavity behind the cheek plate in response to the control signal. If there is no control signal from the microprocessor, a spring moves the actuator rod to a position where it partially obstructs a passage through which the pump output flows. The partial obstruction or constriction creates a pressure drop which is proportional to the speed at which the pump is driven by the engine. The pressure drop is then used to position the spool of the control valve.

16 Claims, 9 Drawing Figures

FUEL SUPPLY SYSTEM

BACKGROUND OF THE INVENTION

The present invention relates to apparatus for delivering fuel to an engine, and in particular to a cheek plate unloading pump for delivering fuel to an engine.

There are various known mechanisms for delivering fuel to an internal combustion engine. Increased fuel economy and improved exhaust emissions from vehicles with internal combustion engines are goals of these known mechanisms. To achieve these goals, systems have been devised which vary the amount of fuel delivered to an engine in response to one or more engine operating conditions. Some systems utilize microprocessors which receive information about variable engine operating conditions from sensors and which produce a signal to control the rate of fuel flow to the engine according to a program stored in the microprocessor. Many different engine operating conditions may be sensed. For example, the ambient air temperature, the rate of air flow into the engine, engine water temperature or oil temperature, manifold vacuum, and engine speed all may be sensed. In addition, one or more properties of the exhaust emissions may be sensed. One such system is shown in U.S. Pat. No. 3,630,643.

In some microprocessor controlled systems, a microprocessor controls an electric motor which drives a fuel pump. For example, in the system disclosed in U.S. Pat. No. 3,935,851, a number of engine operating conditions are sensed, and a microprocessor varies the voltage of the current supplied to an electric motor which drives the fuel pump. When operating conditions dictate an increased fuel supply, the voltage to the fuel pump drive motor is increased. In the event of a failure of the electronic components, the microprocessor will fail to deliver current for the pump drive motor, and the engine receives no fuel and thus cannot operate.

In other microprocessor controlled systems, a microprocessor controls the length of time a fuel injector remains open to regulate the flow of fuel to the engine. An example of such a system is described and illustrated in U.S. Pat. No. 3,971,348. Such systems are also vulnerable to failure of the electronic components since the engine is totally inoperative if the fuel injectors do not receive a signal from the microprocessor.

Similarly, the system disclosed in U.S. Pat. No. 3,949,714 is vulnerable to electronic failure. In this system, sensors send information relating to operating parameters to a microprocessor which in response generates a control signal to actuate a solenoid. The solenoid controls pump output through a servo valve which is spring biased to a position corresponding to minimum output from the pump. Accordingly, upon failure of the electronic components, the spring bias shifts the pump to its minimum output and the engine becomes inoperable.

The system disclosed in U.S. Pat. No. 3,630,643 includes a variable displacement engine-driven fuel pump. The flow output of the pump is controlled by a microprocessor which responds to engine operating conditions. The pump is biased toward maximum flow output. Accordingly, if the microprocessor fails, the pump will deliver the maximum quantity of fuel, without regard to the engine's requirements. The most likely result is flooding of the engine.

The above mentioned microprocessor controls are effective to control the fuel supplied to an engine to maximize engine efficiency and improve emissions. However, when the microprocessor or electronic components fail, the vehicle may become totally inoperable because fuel cannot be delivered to the engine in a quantity which would enable the engine to operate. The vehicle cannot be driven to a repair facility, but instead must either be towed or the repairs must be made on location. Alternatively, the delivery of fuel to the engine may be uncontrolled and extremely inefficient.

SUMMARY OF THE INVENTION

The present invention provides an improved apparatus for delivering fuel to an engine. Specifically, the apparatus relates to systems in which an electrical signal is produced indicative of the fuel flow to be delivered to the engine. If an electrical signal is not produced, fuel flow to the engine is still controlled so that the engine will properly operate.

In a preferred embodiment, a microprocessor controls fuel flow to the engine. When the microprocessor is working properly, the fuel supplied is controlled in response to a plurality of engine operating conditions in order to minimize fuel consumption and improve emissions. In the event that the microprocessor fails, the fuel pump used in the system will supply fuel in a regulated amount so that the vehicle can be driven to a repair facility.

According to the present invention, a microprocessor is fed information about variable engine operating conditions from a plurality of sensors. The variables measured may include ambient air temperature, engine temperature, the rate of air flow into the engine and the composition of exhaust gasses. From this information the microprocessor determines what the fuel flow rate to the fuel rail should be, and it generates a corresponding electric control signal. The control signal actuates a linear actuator which varies the delivery pressure of the fuel pump to thereby vary the fuel flow to the fuel rail. Feedback control by means of a pressure sensor located downstream from the pump's outlet assures that the desired pressure is achieved.

The pump utilized is a cheek plate unloading pump driven by the engine. The delivery pressure of a cheek plate unloading pump is directly proportional to the fluid pressure in a cavity which urges the cheek plate against a cam and rotor. When the pressure in the cavity is reduced, the delivery pressure is reduced because the cheek plate moves away from the cam and rotor. Fluid then flows from contracting to expanding pumping pockets within the pump, rather than to the system supplied by the pump.

A control valve is used to regulate the pressure in the cavity. The control valve includes a spool which is moved in a spool chamber. The spool has lands and grooves on its outside perimeter which cooperate with openings in the walls of the spool chamber to control the flow of fluid from the cavity. The spool is spring biased toward a position corresponding to maximum cavity pressure and therefore maximum delivery pressure at the pump's outlet.

The spool is moved by a solenoid type linear actuator against the spring bias to vent the cavity pressure and thereby to reduce the delivery pressure. The solenoid is actuated by the control signal generated by the microprocessor. The solenoid moves the spool in proportion to the magnitude of the control signal thereby to regulate the delivery pressure between zero and a maximum of about 250 p.s.i.

In the event that the microprocessor fails to generate a control signal, the present invention provides automatically for the fuel pressure to be regulated in proportion to engine speed up to about 90 p.s.i. at maximum engine r.p.m. The spool includes a passage which extends through the spool and connects opposite ends of the spool. The output flow of the fuel pump is directed into the upstream end of a cylindrical spool chamber in which the spool moves and through the passage down the center of the spool. An outlet conduit leading to the fuel rail communicates with the downstream end of the spool chamber.

When the microprocessor is operating normally, the passage through the spool is relatively unobstructed and consequently the difference between the pressure forces acting on the opposite ends of the spool is very near zero. When the microprocessor fails to generate a control signal, the passage through the spool is partially obstructed. The obstruction creates a difference between the pressures acting on the upstream and downstream end faces of the spool, and the spool moves according to the pressure difference against the spring bias. Since the difference in pressure acting on opposite ends of the spool is proportional to engine and pump speed, the delivery pressure is also proportional to engine speed when the microprocessor fails and the spool is moved by this pressure difference.

The construction of the control valve and solenoid permits the transition from microprocessor-solenoid control to engine speed-based control to happen automatically. The core of the solenoid has an actuator rod which extends into the passage through the spool. The end of the actuator rod has a spherical tip. When the solenoid is actuated by the control signal, the end of the actuator rod moves forward and presses against a spider spanning the passage through the spool and thereby moves the spool against the bias of the spring. The position of the spool is controlled by varying the current through the solenoid.

The passage through the spool has two portions of different cross sectional flow areas. The downstream portion has a relatively large cross sectional area. The spider, the spherical tip of the actuator rod and the downstream portion of the passage through the spool are proportioned so that when the spherical tip of the rod abuts the spider, the cross sectional areas for flow through the upstream and downstream portions of the passage are both relatively large. Therefore, there is no significant pressure loss as fluid flows through the passage while the spherical tip of the rod abuts the spider, and the pressure forces acting on opposite ends of the spool are balanced.

If there is a failure of the microprocessor and no current is supplied to the solenoid, the passage through the spool is automatically partially obstructed. In the absence of a control signal, a spring automatically withdraws the actuator rod so that the spherical tip of the actuator rod is positioned in the upstream portion of the central passage through the spool. The diameter of the upstream portion of the central passage through the spool is proportioned so that the spherical tip causes a partial obstruction of the flow through the spool. The partial obstruction creates the difference between the pressures acting on the upstream and downstream end faces of the spool which is used to control the spool's position.

BRIEF DESCRIPTION OF THE DRAWINGS

These and other features of the present invention will become apparent from a consideration of the following specification when taken together with the accompanying drawings which form a part thereof and in which.

DESCRIPTION OF PREFERRED EMBODIMENT

Figure 1:
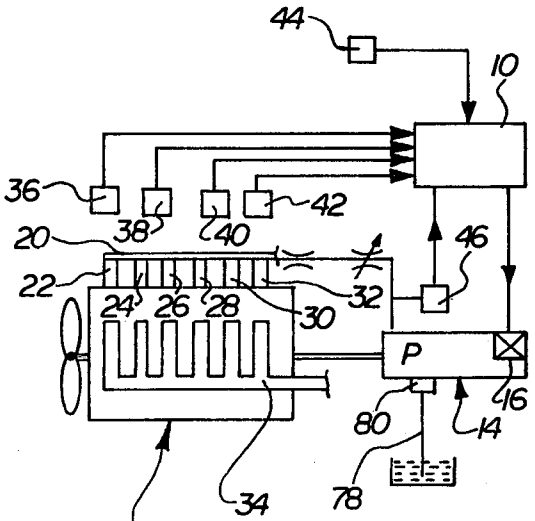
FIG. 1 is a schematic illustration of a fuel control system constructed in accordance with the present invention.

The preferred embodiment of the present invention is a system to control the fuel pressure in the fuel rail of a diesel engine. The system is illustrated schematically in FIG. 1 and includes a microprocessor 10 which generates an electric control signal in response to variations in the operating conditions of diesel engine 12. The control signal generated by the microprocessor varies the output of an engine driven cheek plate unloading pump 14 by actuating a solenoid 16 which is part of a control valve associated with the pump 14. In FIG. 1A the upper curve A illustrates the variation in fuel rail pressure as a function of engine speed from no pressure when the engine is shut off to a maximum of about 250 p.s.i. at maximum engine speed. The actual maximum pressure depends on characteristics of the fuel injectors and may be more than or less than the 250 p.s.i. illustrated.

If the microprocessor 10 fails to generate a control signal for the solenoid 16, the control valve varies the fuel pressure in response to the engine speed. This enables a vehicle equipped with the present invention to be driven to a repair facility, although it won't operate with maximum efficiency. The lower curve B in FIG. 1A shows how the pressure in the fuel rail varies when the microprocessor is not functioning. The fuel pressure increases with engine speed from zero when the engine is stopped up to a maximum of about 90 p.s.i. at maximum engine speed. The pressure increases less rapidly than when the system is under microprocessor control and reaches a maximum pressure of about 90 p.s.i. before maximum engine speed is reached. Further increases in engine speed produce no increase in fuel pressure. The actual maximum fuel pressure when the microprocessor is not functioning may be more than or less than 90 p.s.i. depending on the dimensions of surface areas within the pump 14 on which fuel pressure acts, as will become apparent from the discussion below. The specification that follows describes first the control system generally, then the cheek plate unloading pump 14, and finally the control valve.

Control System

Figure 1A:
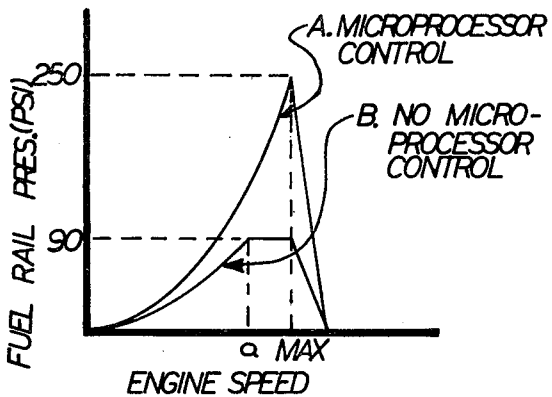
FIG. 1A is a graph with one curve illustrating the fuel pressure in the fuel rail of a diesel engine equipped with the system of the present invention when the system is under microprocessor control and one curve illustrating the fuel pressure in the fuel rail of a diesel engine when the microprocessor is not operating.

The system of the present invention may be used with a diesel engine 12 (FIG. 1). A fuel pump 14 has a variable delivery pressure, and it delivers fuel to a fuel rail 20. A plurality of fuel injectors 22, 24, 26, 28, 30 and 32 are connected with the fuel rail 20 in a conventional manner. When the engine 12 is operating, fuel is fed to the fuel rail 20, through the injectors 22–32 and into the engine where it is burned. Exhaust manifold 34 collects the engine exhaust in the usual manner.

The microprocessor 10 controls the pressure of the fuel supplied to the fuel rail 20 according to the upper curve in FIG. 1A. By varying the delivery pressure of the fuel from the pump 14, the amount of fuel flowing into the injectors per unit of time can be varied. Since the injectors are open for a predetermined period of time (either dependent on or independent of engine speed), varying the fuel rail pressure is effective to vary the rate of fuel consumption by the engine 12.

The microprocessor 10 is programmed to achieve maximum fuel economy and minimum exhaust emissions. It could, however, be programmed to achieve other operating results, such as maximum torque. The microprocessor receives information about various engine operating conditions from sensors 36, 38, 40, 42 and 44. These sensors may sense, for example, the ambient air temperature, the flow rate of air into the engine, the engine speed, the chemical composition of the exhaust gases, and the amount of particulates in the exhaust. Other engine variables could be sensed instead of or in addition the variables noted above.

The microprocessor 10 generates a control signal in response to the various sensor inputs to it. The control signal in turn actuates the solenoid 16 to vary the delivery pressure of the pump 14 and therefore the pressure of the fuel supplied to the fuel rail 20.

In order to assure that the delivery pressure of the pump 14 is the desired pressure, a pressure sensor 46 is provided to measure the delivery pressure of the pump 14. The output of the pressure sensor 46 is fed back to the microprocessor 10 and forms a closed loop control. The microprocessor 10 measures the difference between the actual delivery pressure, as measured by the pressure sensor 46, and the desired output pressure and corrects the control signal accordingly.

In summary, the control system of the present invention includes a microprocessor 10 which generates a control signal to vary the output pressure of a pump 14 in response to numerous different engine operating conditions. The microprocessor 10 chooses the desired delivery pressure of the pump 14 to achieve specific operating characteristics from the engine 12. The specific engine variables measured and the program in the microprocessor depend on the engine design, use, and the desired operating characteristics.

Pump

Figure 4:
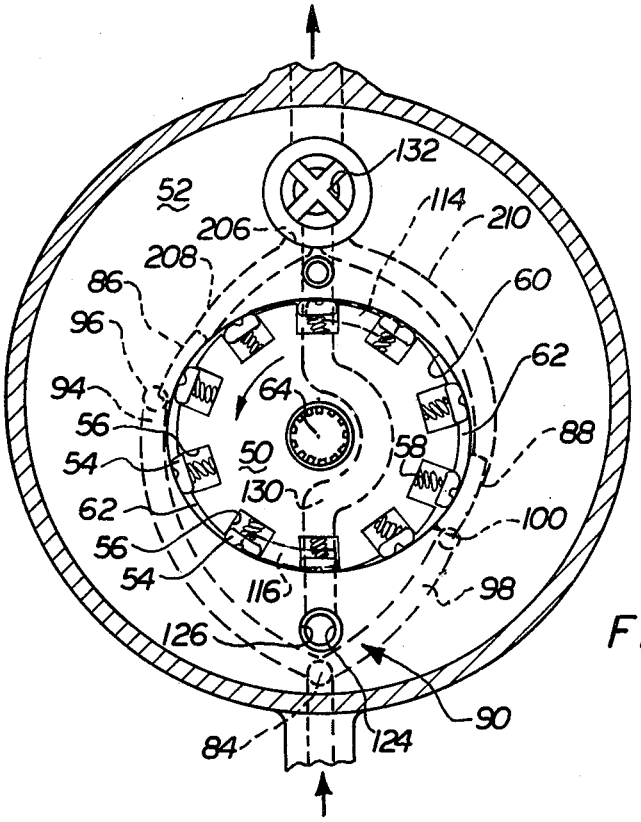
FIG. 4 is a sectional view taken along line 4—4 of FIG. 2.

The pump 14 (FIG. 2) includes a rotor 50 which turns within a cam ring 52. The rotor 50 carries a plurality of slippers 54 in slots 56 (FIG. 4) formed in its outer periphery. The slippers 54 are biased by springs 58 against the internal periphery 60 of the cam ring 52. The rotor 50, cam ring 52, and slippers 54 define a plurality of pumping pockets 62 which expand and contract as the rotor rotates. The expansion and contraction results from movement of the slippers radially in and out of the slots 56 as the slippers follow the shape of the internal periphery 60 of the cam ring.

The rotor 50 is connected by splines with shaft 64 which is driven by the engine. The shaft 64 is rotatably supported by a plain bearing 66 (FIG. 2) which is in turn mounted in a hub 68. A suitable oil seal 70 encircles the shaft 64 where it projects outwardly from the hub 68. A generally tubular housing 72 surrounds the cam 54, rotor 50 and hub 68. The housing 72 is fixed to the hub 68 by being crimped around the edge 74 of the hub.

Figure 2:
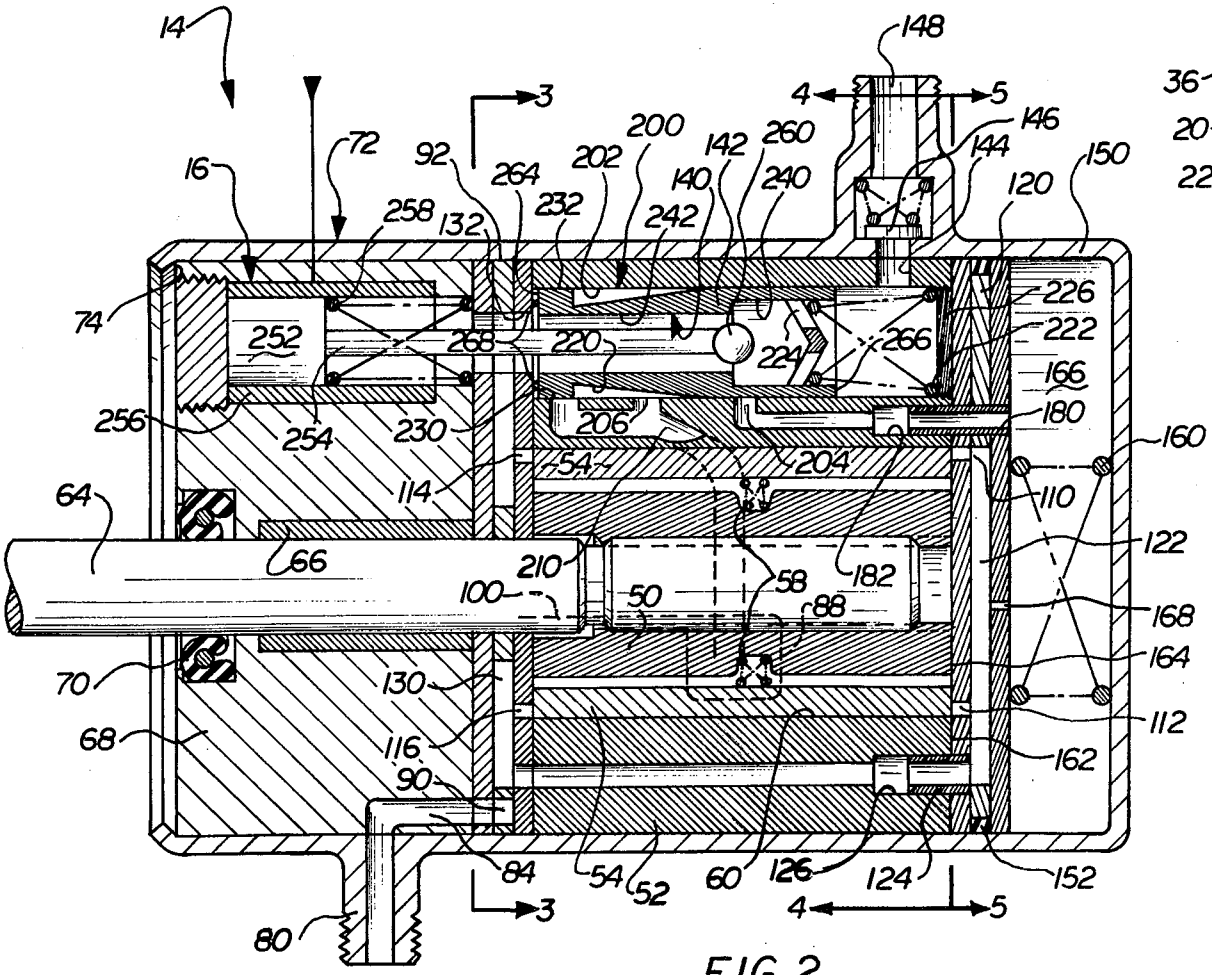
FIG. 2 is a sectional view through a fuel pump shown in FIG. 1.
Figure 3:
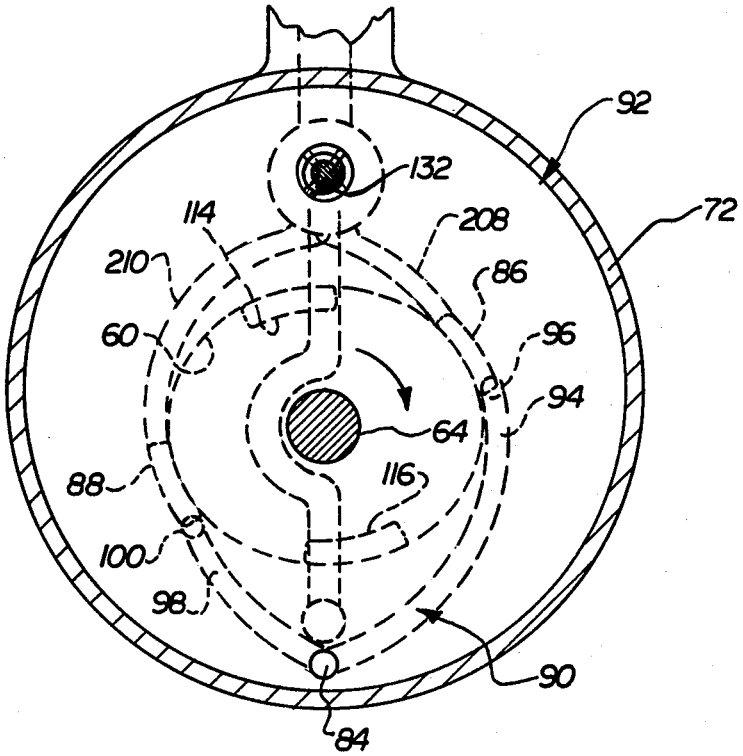
FIG. 3 is a sectional view taken along line 3—3 of FIG. 2.

An inlet conduit 78 (FIG. 1) is connected with a supply of diesel fuel and is connected with the pump inlet 80. The inlet 80 (FIG. 2) is connected with a passage 84 and ultimately with two inlet ports 86 and 88 (FIG. 3) located in the cam ring 52. The passage 84 communicates with an arcuate passage 90 in end plate 92. The arcuate passage 90 extends circumferentially within the end plate 92 (FIG. 3). One end portion 94 of passage 90 communicates with a passage 96 which extends axially through the cam ring 52. The passage 96 in turn communicates with the port 86. The opposite end portion 98 of the arcuate passage 90 communicates with a corresponding passage 100 (FIGS. 2 and 3) which extends axially through the cam ring 52 to communicate with the inlet port 88.

The inlet ports 86 and 88 are positioned diagonally across from each other around the internal periphery 60 of the cam ring 52 and symmetrically about the axis of rotation of the shaft 64. The inlet ports 86 and 88 are positioned midway along the axial length of the rotor 52 (FIG. 2). Fluid is drawn in through the inlet 80, passage 84, arcuate passage 90, passages 96 and 100 through the ports 86 and 88, and into the expanding pumping pockets 62.

The pump is provided with outlet ports 110, 112, 114 and 116 (FIG. 2). The outlet ports 110 and 112 are formed in a cheek plate 120, and the ports 114 and 116 are formed in the end plate 92. The outlet ports 110 and 112 are located at axially opposite ends of the rotor 50 and cam ring 52 from the outlet ports 114 and 116. Therefore, the flow through the pumping pockets 62 is from the axial midline of the rotor 50, where the inlet ports 86 and 88 are located, axially in opposite directions to the outlets 110, 112 and 114, 116 as the pumping pockets 62 contract. The pressure in a contracting pumping pocket is termed herein the outlet pressure, although, as is discussed below, the pressure delivered to the fuel rail may be reduced from the outlet pressure by the internal arrangement of the pump 14.

Figure 5:
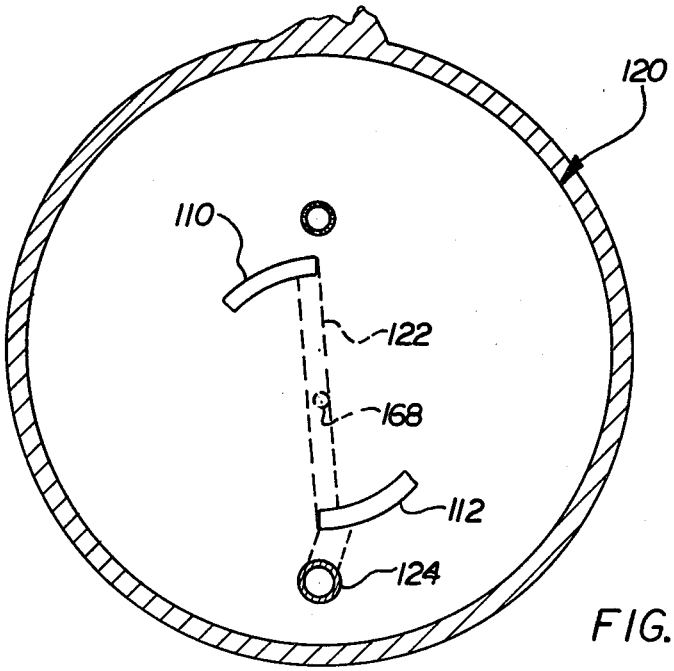
FIG. 5 is a sectional view taken along line 5—5 of FIG. 2.

The cheek plate 120 (FIGS. 2 and 5) includes an internal passage 122 which connects the outlet ports 110 and 112. The passage 122 communicates with a tubular member 124 which is press fit into the cheek plate 120. The tubular member 124 fits into and slides axially in a passage 126 (FIG. 2) in the cam ring 52. The passage 126 extends axially through the cam ring 52. Suitable seals (not shown) are provided between the exterior of the tubular member 124 and the walls of the passage 126. Outlet flow from the contracting pumping pockets passes through ports 110 and 112 into passage 122 in the cheek plate 120. From the passage 122, the flow is through tubular member 124 and passage 126 into an internal passage 130 in the end plate 92.

The flow from outlet ports 114 and 116 (FIGS. 2, 3 and 4) is also into passage 130 in the end plate 92. The passage 130 extends diametrically across the end plate 92 with a curve to circumvent the shaft 64 (see FIG. 3). The passage 130 communicates with an opening 132 in the end plate 92. Thus, all the flow of fluid expelled from the contracting pumping pockets is collected in passage 130 and is directed to the opening 132. From the opening 132 (FIG. 2), the flow of fluid expelled from the contracting pumping pockets is through a passage 140 in a spool 142, through a passage 144 in the cam ring 52 and through a check valve 146 to the delivery connection 148. The pressure of the fuel in the delivery connection 148 is termed herein the delivery pressure and is the controlled variable of the system. When the delivery pressure is varied, the amount of fuel injected into the engine on each cycle is also varied.

The cheek plate 120 is axially movable relative to the cam ring 52 and rotor 50 to control the delivery pressure. The cheek plate 120 is slidable in a direction parallel with the axis of shaft 64 inside the closed end portion 150 of the tubular housing member 72. A seal 152 prevents leakage between the perimeter of the cheek plate 120 and the interior of the tubular member 72.

The cheek plate 120 is biased by spring 160 toward engagement with end face 162 of the cam ring 52 and end face 164 of the rotor 50. In addition to the biasing force of the spring 160, fluid pressure in cavity 166 urges the cheek plate 120 toward end face 162 of the cam ring 52 and end face 164 of the rotor 50. The cavity 166 is defined by the closed end portion 150 of the tubular housing member 72. When the cheek plate 120 is in sealing engagement with the end faces 164 and 162 of the cam ring and rotor, the flow of fluid from the contracting pumping pockets 62 is as has been described above. When the cheek plate 120 moves away from end faces 162 and 164, then fluid from the contracting pumping pockets flows to the expanding pumping pockets across the end faces 162 and 164. This reduces the pressure at the delivery connection 148.

Movement of the cheek plate 120 is controlled by the fluid pressure in cavity 166. The cavity 166 is supplied with fluid from the contracting pumping pockets through an orifice 168 in cheek plate 120. The combined force of the spring 160 and the fluid admitted into the cavity 166 through passage 168 tends to maintain the cheek plate 120 against the end faces 162 and 164 of the cam 52 and rotor 50, respectively.

Control Valve

The pressure in cavity 166 may be reduced by permitting fluid to flow out of the cavity through control valve 200 disposed in the cam ring 52. When the valve 200 is open, fluid flows out of cavity 166 through a tubular member 180. Tubular member 180 is press fit in the cheek plate 120 and extends all the way through the cheek plate to communicate at one end with the cavity 166. The other end of the tubular member 180 slides in a passage 182 in the cam 52. A suitable seal (not shown) is provided to permit axial movement of the tubular member 180 in the passage 182 without leakage of fluid.

The control valve 200 includes the previously mentioned spool 142 and a cylindrical passage 202 or spool chamber in the cam ring 52. Passage 202 communicates with passage 182 from chamber 166 through an opening 204 into the interior of passage 202. Also communicating with the cylindrical passage 202 is an opening 206 which leads through a passage 208 (FIG. 4) to inlet port 86 and through passage 210 to inlet port 88.

The spool 142 (FIG. 2) slides in spool chamber 202 to control the flow of fluid from opening 204 to opening 206. The spool 142 has a tapered or conical surface portion 220 on its outside surface. As spool 142 moves, the conical surface 220 may overlap the opening 204 at the end of passage 182. Changes in the degree of overlap will vary the flow of fluid from passage 182 through opening 204 to opening 206. A spring 222 biases the spool 142 to the left as viewed in FIG. 2 and thus toward a position corresponding to no flow between openings 204 and 206. The spring 222 acts between a spider 224 which spans passage 140 in the spool 142 and a plug 226 which is screwed into spool chamber 202. The plug 226 seals one end of the spool chamber 202.

Changing the axial position of the spool 142 varies the flow between openings 204 and 206 and thus varies the pressure in cavity 166. This in turn varies the pressure at the delivery connection 148 of the pump 14 as previously described.

Figure 6:
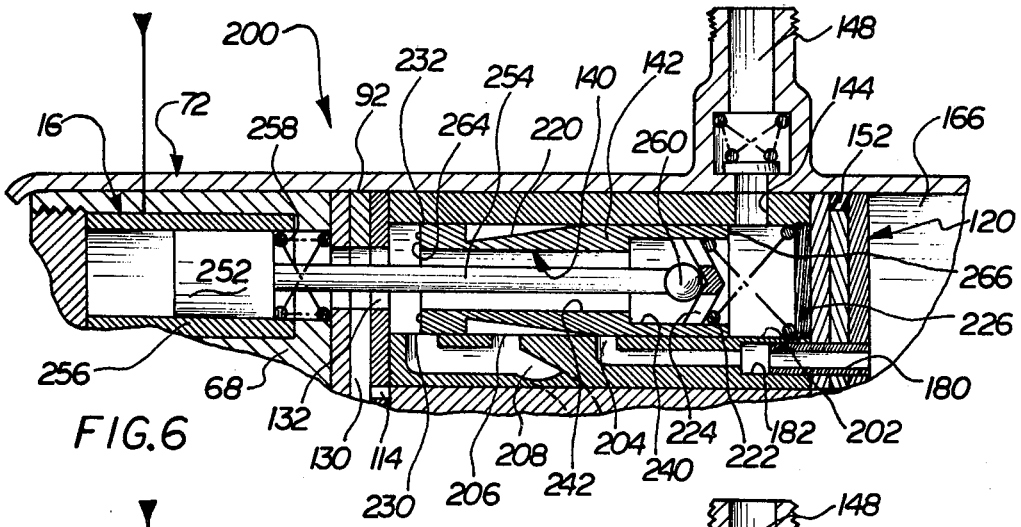
FIG. 6 is an enlarged view of a control valve forming a portion of the pump shown in FIG. 2.

An opening 230 into the spool chamber 202 communicates with the passage 208 and cooperates with a land 232 on the spool 142. The opening 230 and the land 232 are positioned relative to the tapered surface 220 and the openings 204 and 206 so that as the spool 142 moves to the right, as viewed in FIG. 2, to the position shown in FIG. 6, there is a small flow of fluid from the opening 132 in the end plate 92 through the opening 230. This fluid flow is intended to stabilize the spool 142. The function and operation of such a stabilizing flow is described in detail in U.S. Pat. No. 4,014,630, which is incorporated by reference herein. The stabilizing flow only slightly reduces the flow of fluid through the delivery connection 148.

Figure 7:
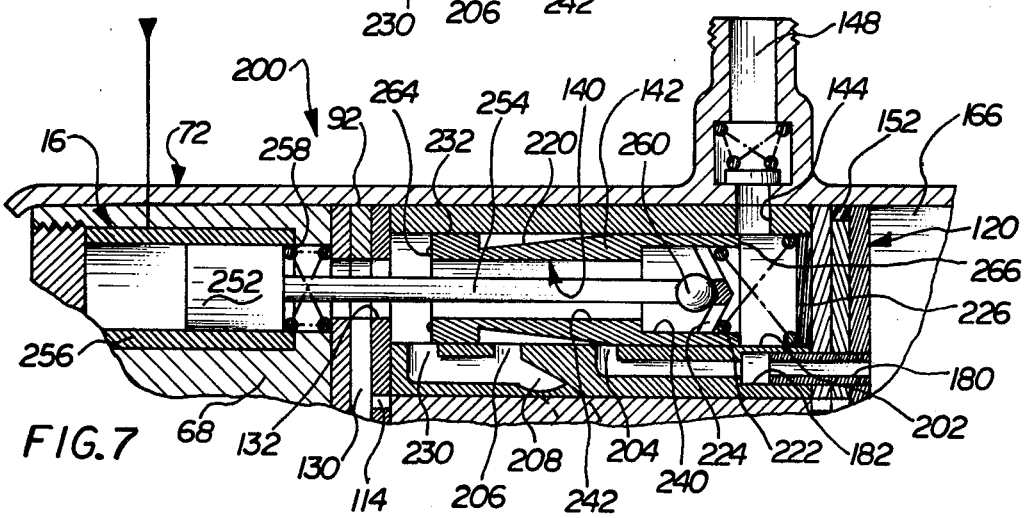
FIG. 7 is a view generally similar to FIG. 6 but showing the control valve moved to an operating position.

The control valve 200 (FIG. 2) includes a solenoid type linear actuator 16 which moves the spool 142 axially in the spool chamber 202. The solenoid 16 includes a core 252 to which an actuator rod 254 is connected. The actuator rod 254 extends axially into the passage 140 through the spool 142. When an electric current is supplied to winding 256 of the solenoid 16, the actuator rod 254 can be moved into engagement with the spider 224 (FIG. 6) and can slide the spool against the bias of spring 222 (FIG. 7) to control the flow of fluid out of the cavity 166.

The solenoid winding 256 is actuated by a control signal generated by the microprocessor 10 (FIG. 1). Current through the coil 256 urges the core 252 and actuator rod 254 to the right to move the spool 142 against the bias of spring 222, for example, to the position illustrated in FIG. 7. The magnitude of the current through the core 256 varies according to the desired delivery pressure of the pump. Shifting the axial position of the spool 142 in the spool chamber 202 varies the flow between openings 204 and 206 and thereby controls the pressure at the fuel rail in the manner previously described.

In the event that the microprocessor fails to generate a control signal, the control valve 200 automatically provides fuel at a delivery pressure which is proportional to engine speed over a first part of the range of engine speeds. Thereafter, delivery pressure does not increase with increasing engine speeds (see curve B in FIG. 1A). This enables the vehicle driven by the engine to "limp home" for repairs.

To provide the "limp home" capability, the passage 140 (FIG. 2) through the spool 142 has a downstream portion 240 which is of a larger diameter than the upstream portion 242. The spider 224 is located in the downstream, larger diameter portion 240. The actuator rod 254 is formed with a spherical tip or end portion 260. The diameter of the spherical tip 260 and the cross sectional area of the actuator rod 254 are selected so that when the tip 260 is in engagement with the spider 224, the cross sectional areas for fluid flow through the upstream and downstream portions 240 of the passage 140 are both relatively large. Thus, there is very little difference between the pressure upstream of the spool 142 and the pressure downstream of the spool. When the solenoid 16 is operating to position the spool 142 in the cylindrical passage 202 (See FIGS. 6 and 7), the net pressure force acting on the upstream end face 264 of the spool 142 is the same as the net pressure force acting on the downstream end face 266 of the spool, and the position of the spool 142 in the spool chamber 202 is essentially unaffected by pressure forces.

Figure 8:
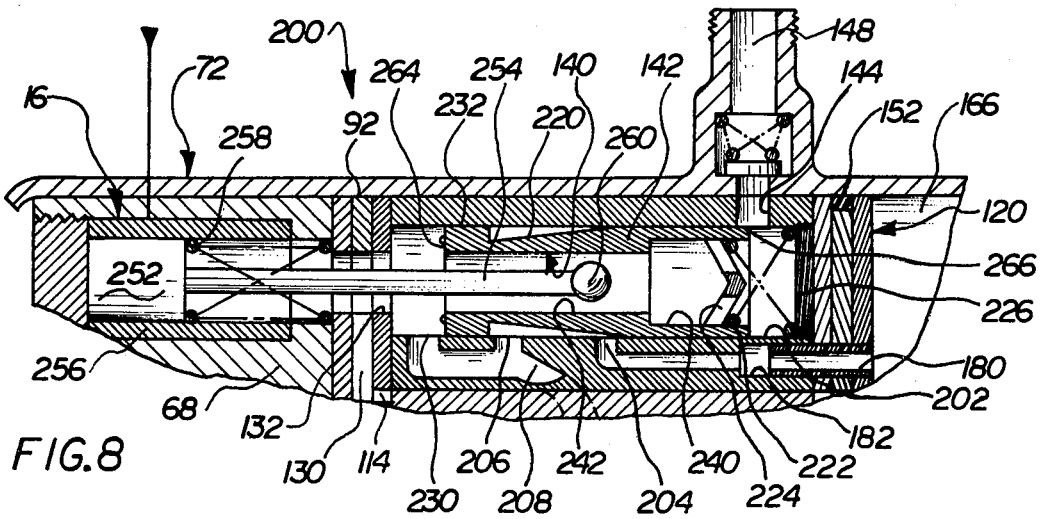
FIG. 8 is a view generally similar to FIG. 7 but showing the control valve in another operating position.

When there is no current supplied to the solenoid 16, the core 252 moves to the left to the position illustrated in FIGS. 2 and 8. The spherical tip 260 is then drawn into the smaller diameter portion 242 of the passage 140. The spherical tip 260 forms a constriction which partially obstructs the flow through the passage 140 and creates a higher pressure on the upstream side of the spherical tip 260 than on the downstream side. Therefore, the pressure force acting on the upstream end face 264 of the spool 142 is larger than the pressure force acting on the downstream face 266 of the spool. Bumps or ridges 268 (FIG. 2) on end face 264 space the end face 264 away from end plate 92 so that the upstream fluid pressure can reach the face 264 to act upon it.

The spring 222 urges the spool toward the left, as viewed in FIGS. 2 and 8, while the difference between the pressure forces acting on end faces 264 and 266 of the spool tends to urge the spool to the right. The magnitude of the difference between the pressure forces acting on end faces 264 and 266 of the spool 142 depends on the dimensions of spherical tip 260, the passage 242 and the end faces 264 and 266, as well as the speed of rotation of the rotor 50. For a given set of physical dimensions, the faster the rotor 50 turns, the greater the pressure in opening 132, the faster the fluid flows through passage 140, and the greater the difference between the pressures acting on end faces 264 and 266 of the spool 142. Thus, the force tending to urge the spool 142 to the right is dependent upon the speed of pump rotation. The spring constant or stiffness of spring 222 is selected in accordance with the various physical dimensions noted above so that difference in pressure forces acting on faces 264 and 266 of the spool 142 moves the spool to the right to vent the cavity 166 when the delivery pressure of the pump 14 reaches $\frac{1}{3}$ to $\frac{1}{2}$ of the maximum delivery pressure of the pump under microprocessor control. In this way the control valve 200 provides a fuel delivery pressure which up to speed "a" in FIG. 1A is proportional to engine speed, but less than normal. For engine speeds in excess of speed "a", the fuel rail pressure remains constant. The vehicle operator will therefore immediately recognize that repair is required but will be able to return the vehicle under its own power for repairs.

The present invention provides a microprocessor controlled fuel injection system which includes a built in "limp home" capability. When the microprocessor 10 (FIG. 1) is working properly, the delivery pressure of the fuel supplied to the fuel rail 20 is controlled in response to a plurality of engine operating conditions in order to maximize economy and minimize emissions. In the event that the microprocessor 10 should fail, the fuel pump 14 used in the present invention is able to supply fuel at a pressure proportional to engine speed so that the vehicle can be driven to a repair facility.

The pump 14 (FIG. 2) utilized is a cheek plate unloading pump driven by the engine. The output pressure of a pump 14 of this type is directly proportional to the fluid pressure in cavity 166 which urges a cheek plate 120 against a cam ring 52 and rotor 50. When the pressure in the cavity 166 is reduced, the output or delivery pressure is reduced because the cheek plate 120 moves away from the cam ring 52 and rotor 50 and fluid flows from contracting to expanding pumping pockets within the pump instead of through the delivery connection 148 to the system supplied by the pump.

In the pump 10 constructed according to the present invention, the control valve 200 regulates the pressure in the cavity 166. The control valve 200 includes a spool 142 which is moved in a spool chamber 202. The spool 142 has lands and grooves 232 and 220 on its outside perimeter which cooperate with openings 204 and 206 in the walls of the spool chamber 202 to control the flow of fluid from the cavity 166. The spool 142 is spring biased toward a position corresponding to maximum cavity pressure and therefore maximum pump delivery pressure. The spool 142 is moved by a solenoid type linear actuator 16 against the bias of spring 222 to vent the cavity pressure and thereby reduce the delivery pressure. The solenoid 16 is actuated by the control signal generated by the microprocessor 10 (FIG. 1). The solenoid 16 moves the spool 142 (FIG. 2) in proportion to the magnitude of the control signal to thereby regulate the delivery pressure of the pump according to curve A in FIG. 1A.

In the event that the microprocessor fails to generate a control signal, the present invention provides automatically for the fuel pressure to be regulated according to curve B in FIG. 1A. The spool 142 includes a passage 140 which extends through the spool connecting opposite ends 264 and 266 of the spool. The output flow of the pump 14 is directed into the upstream end of the cylindrical chamber 202 in which the spool 142 moves and through the passage 140 down the center of the spool. An outlet conduit 144 leading to the fuel rail 20 (FIG. 1) communicates with the downstream end of the spool chamber 202 (FIG. 2).

When the microprocessor 10 (FIG. 1) is operating normally, the passage 140 (FIG. 2) through the spool 142 is relatively unobstructed, and consequently the net pressure force acting on the opposite ends of the spool is nearly zero. When the microprocessor 10 (FIG. 1) fails to generate a control signal, the passage 140 (FIG. 2) through the spool 142 is partially obstructed. This creates a difference between the pressure acting on the upstream and downstream end faces 264 and 266, respectively, of the spool 142, and the spool moves accordingly against the bias of spring 222. Since the pressure difference acting on opposite ends of the spool 140 is proportional to engine and pump speed when the microprocessor fails and the spool is moved by this pressure difference, the delivery pressure is also proportional to engine speed, at least until a predetermined engine speed, indicated as speed "a" in FIG. 1A is reached. At speeds greater than "a", delivery pressure remains constant.

What is claimed is:

1. Apparatus for delivering fuel to an engine, said apparatus comprising a fuel pump driven by the engine, an outlet conduit means for directing fuel from said pump to the engine, means for providing an electrical signal indicative of the fuel flow to be delivered from said pump to the engine, and a control valve for controlling the fuel flow through said outlet conduit means to the engine in response to said electrical signal when said means for providing an electrical signal is functioning and in response to changes in pump speed upon failure of said means for providing an electrical signal, said control valve comprising a valve spool having first and second opposed surfaces upon which fuel pressure acts, and means for creating a pressure difference acting on said valve spool proportional to pump speed when the means for providing the electrical signal fails to control the fuel flow.

2. Apparatus for delivering fuel to an engine, said apparatus comprising a fuel pump driven by the engine, an outlet conduit means for directing fuel from said pump to the engine, means for providing an electrical signal indicative of the fuel flow to be delivered from said pump to the engine, a control valve for controlling the fuel flow through said outlet conduit means to the engine in response to said electrical signal when said means for providing an electrical signal is functioning and in response to changes in pump speed upon failure of said means for providing an electrical signal, said pump comprising a cheek plate pump in which fluid pressure in a cavity controls the position of a cheek plate thereby to control the flow delivered by said pump, and said control valve controls a flow of fluid through said cavity thereby to vary the fluid pressure in said cavity.

3. Apparatus for delivering fuel to an engine, said apparatus comprising a fuel pump driven by the engine, an outlet conduit means for directing fuel from said pump to the engine, means for providing an electrical signal indicative of the fuel flow to be delivered from said pump to the engine, a control valve for controlling the fuel flow through said outlet conduit means to the engine in response to said electrical signal when said means for providing an electrical signal is functioning and in response to changes in pump speed upon failure of said means for providing an electrical signal, said means for providing an electrical signal comprising a microprocessor, and sensor means for sensing at least one engine operating parameter and providing a signal to said microprocessor, and said control valve including a valve spool and solenoid means actuated by said electrical signal for moving said valve spool in response to said electrical signal.

4. Apparatus as set forth in claim 3 further including biasing means for urging said spool toward a position corresponding to maximum fuel flow.

5. Apparatus as defined in claim 3 wherein said valve spool has first and second opposed surfaces upon which fluid pressure acts, and said valve further includes a flow-restricting member movable into and out of a position in which said flow-restricting member forms a constriction in said control valve, the pressure on opposite sides of said constriction acting on said first and second opposed surfaces of said valve spool, and means for moving said flow-restricting member into said position forming said constriction upon failure of said means for providing an electric signal.

6. Apparatus as defined in claim 5 wherein said valve spool has a passage therethrough which passage includes first and second portions, one of said portions having a larger cross sectional flow area than the other of said portions, said flow restricting member being movable between a position in said large portion in which flow through said passage is substantially unrestricted and a position in said smaller portion in which the flow through said passage is restricted.

7. Apparatus as defined in claim 6 wherein said solenoid means includes an actuator rod which is urged to move axially in a first direction in response to said electrical output signal, and said flow restricting member is carried on an end portion of said actuator rod.

8. Apparatus as defined in claim 7 wherein a spider means spans said larger portion of said passage through said spool and said actuator rod is movable into abutting engagement with said spider means to transmit force from said solenoid means to move said spool.

9. Apparatus as defined in claim 7 wherein said means for moving said flow restricting member into said flow constricting position upon failure of said means for providing an electrical signal includes spring means urging said actuator rod in a second direction opposite to said first direction.

10. An apparatus comprising pumping means having an inlet port and outlet port and operable to pump fluid from said inlet port to said outlet port, said pumping means including a rotor and pumping elements which define a series of pumping pockets which expand and contract to effect pumping of fluid upon rotation of said rotor, means defining an outlet passage communicating with said outlet port, a cheek plate having one axial side thereof facing said rotor, means defining a cavity on the other axial side of said cheek plate, means defining a passage directing fluid from said outlet port to said cavity, the pressure in said cavity urging said cheek plate toward said rotor, said cheek plate having a position adjacent said rotor blocking fluid communication between said pumping pockets and movable therefrom to communicate said expanding and contracting pockets and thus bypass fluid in amounts depending upon the position thereof, valve means including a valve spool movable to vent said cavity and operable to control the pressure in said cavity to enable the forces on said cheek plate to move said cheek plate away from said rotor, solenoid means for moving said spool in response to an electrical signal and means for effecting movement of said spool in response to the speed at which said rotor rotates in the absence of an electrical signal to said solenoid means.

11. Apparatus as set forth in claim 10 wherein said valve means includes biasing means for urging said spool in a first direction and said solenoid means is effective to urge said spool in a second direction opposite from said first direction.

12. An apparatus as set forth in claim 10 wherein said means for effecting movement of said spool in response to the speed at which said rotor rotates includes first and second opposed faces on said spool, said spool being located in said outlet passage and having a fluid passage therethrough for outlet fluid flow, a flow restricting member movable into and out of a position in which said flow-restricting member forms a constriction in said fluid passage, means for communicating fluid pressure from opposite sides of said constriction to said first and second opposed faces of said spool, and means for moving said flow restricting member into said constriction forming position in the absence of an electrical signal to said solenoid means.

13. An apparatus as set forth in claim 12 wherein said fluid passage through said spool includes first and second portions, said first portion having a smaller cross sectional flow area than said second portion, and said flow restricting member is disposed in said first portion when said flow restricting member is in said constriction-forming position.

14. An apparatus as set forth in claim 13 wherein said solenoid means includes a rod, said rod extending axially into said fluid passage through said spool, said spool includes spider means spanning said second portion of said passage through said spool, and said rod being movable into abutting engagement with said spider to transmit force from said solenoid means to said spool in response to the electrical signal.

15. An apparatus as set forth in claim 14 wherein said flow restricting member is connected with said rod.

16. An apparatus as set forth in claim 15 wherein said solenoid means includes biasing means for urging said rod to a position in which said flow-restricting member is disposed in said first portion of said passage through said spool.

* * * * *